US009784531B1

(12) United States Patent
Baker

(10) Patent No.: US 9,784,531 B1
(45) Date of Patent: Oct. 10, 2017

(54) RIFLE CARRIER APPARATUS

(71) Applicant: Gary Wayne Baker, Belen, NM (US)

(72) Inventor: Gary Wayne Baker, Belen, NM (US)

( * ) Notice: Subject to any disclaimer, the term of this patent is extended or adjusted under 35 U.S.C. 154(b) by 87 days.

(21) Appl. No.: 15/064,149

(22) Filed: Mar. 8, 2016

(51) Int. Cl.
*F41C 33/00* (2006.01)
*F41C 33/06* (2006.01)
*F41C 33/04* (2006.01)

(52) U.S. Cl.
CPC ..... *F41C 33/06* (2013.01); *F41C 33/041* (2013.01); *F41C 33/046* (2013.01)

(58) Field of Classification Search
CPC ..... F41C 33/007; F41C 33/06; F41C 33/006; F41C 33/005; F41C 33/003; F41C 33/046; A45F 3/04; A45F 3/14; Y10S 224/913
USPC ..... 224/646, 913
See application file for complete search history.

(56) References Cited

U.S. PATENT DOCUMENTS

| | | | | |
|---|---|---|---|---|
| 2,715,989 | A | 8/1955 | Sjodin | |
| 3,501,074 | A | 3/1970 | Emerick | |
| 3,701,371 | A | 10/1972 | Stackhouse | |
| 5,678,344 | A * | 10/1997 | Jones | F41C 33/06 42/96 |
| 7,185,607 | B1 * | 3/2007 | Pearson | F41C 33/06 42/96 |
| D622,808 | S * | 8/2010 | Obradovich | D22/108 |
| 9,194,655 | B1 * | 11/2015 | Cha | A45F 3/14 |
| 2013/0146628 | A1 | 6/2013 | Gump | |
| 2014/0151413 | A1 * | 6/2014 | Ponder | F41C 33/046 224/149 |

* cited by examiner

*Primary Examiner* — Adam Waggenspack
(74) *Attorney, Agent, or Firm* — Peacock Myers, P.C.; Jeffrey Myers; Justin Muehlmeyer

(57) ABSTRACT

A rifle carrying case secured to the front of a person, either by a harness with shoulder straps or by components to attach the case to the straps of the person's backpack, in a way that allows the person to travel hands free of the case and that allows the person to change the orientation of the case.

11 Claims, 4 Drawing Sheets

RIFLE CARRIER APPARATUS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to rifle carrying cases and harnesses. Specifically, the invention relates to a soft case for a rifle or shotgun that is securable to the front of a person.

Description of Related Art

A number of rifle cases and rifle harnesses exist that attempt to offer hunters a solution to the issues they face carrying their rifles in the field. Hunters often travel with their rifles over long distances, which without an adequate protective cover of the rifle, exposes the rifle's sensitive components to the damaging elements of nature. Cases protect the rifle from the elements, but cases also impede the ability of the hunter to access the rifle in seconds and the hunter's acts of accessing the rifle in the case may cause movement and noise that spook game. Hunters need quick access to the rifle within seconds because the presence of game within range of the rifle often is a matter of seconds. Game are highly sensitive to sound and movement such that when a hunter approaches game, any sound or movement may spook the game away.

There are hands free rifle carrying cases and hands free harnesses that secure the case to the hunter's back. Cases secured to the hunter's back require the hunter to make drastic and sound producing movements to access the weapon that spook the game. What is needed is a rifle carrying case securable to the front of the hunter, which allows for quick and silent access to the gun with as little movement as possible.

There are a number of hands free rifle carrying cases securable to a person by a single shoulder strap. However, these cases are problematic for hunters travelling over terrain that may force the hunter to maneuver in ways that cause rifle slings to fall off the hunter's shoulder. Furthermore, single strap devices are burdensome on hunters travelling long distances because the weight of the rifle is carried on a single shoulder and not evenly distributed across the hunter's body. There are hands free harnesses that secure a rifle to the hunter's back by several straps to prevent the rifle's movement in multiple dimensions, which addresses some of these issues of slipping slings and weight distribution, but suffers from the problems discussed above regarding rifles secured to the hunter's back and lack a protective case for the rifle.

There are hands free rifle carrying devises and hands free harnesses that support a rifle at the hunter's front by attaching a support cradle to straps of a harness. However, these carrying devices fail to support the rifle when the axis of the rifle is oriented at an angle substantially above the horizontal. The cradles on these carrying devices are not removably attachable from the harness or adjustable on the harness, making it impossible for the hunter to separate the cradle from the harness and making it impossible for the hunter to vary the orientation or positioning of the rifle cradle. This is problematic because hunters often need to orient the rifle case at angles substantially above a horizontal or position the case to the side of their body as a matter of maneuvering over terrain or as a matter of comfort.

BRIEF SUMMARY OF THE INVENTION

Embodiments of the present invention comprise rifle carrying cases and harnesses capable of use with nearly all types of rifles. One embodiment comprises a case that covers a substantial part of the rifle to protect the rifle from the natural elements while allowing access to the rifle within seconds through an aperture at the top of the case. The case is secured to the front of a person, either by a harness with shoulder straps or by components for attaching the case to the straps of the person's backpack, in a way that allows the person to travel hands free of the case even when the case is oriented vertically, that distributes the weight of the rifle on both of the person's shoulders, that prevents slippage of the case from the person's body for multiple dimensions of movement, and that allows the person to change the orientation of the case from the person's front to the person's side and change the angle of the case relative to the horizontal.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate several embodiments of the present invention and, together with a description, serve to explain the principles of the invention. The drawings are only for the purpose of illustrating one or more particular embodiments of the invention and are not to be construed as limiting the invention. In the drawings.

DETAILED DESCRIPTION OF THE INVENTION

Figure 1:
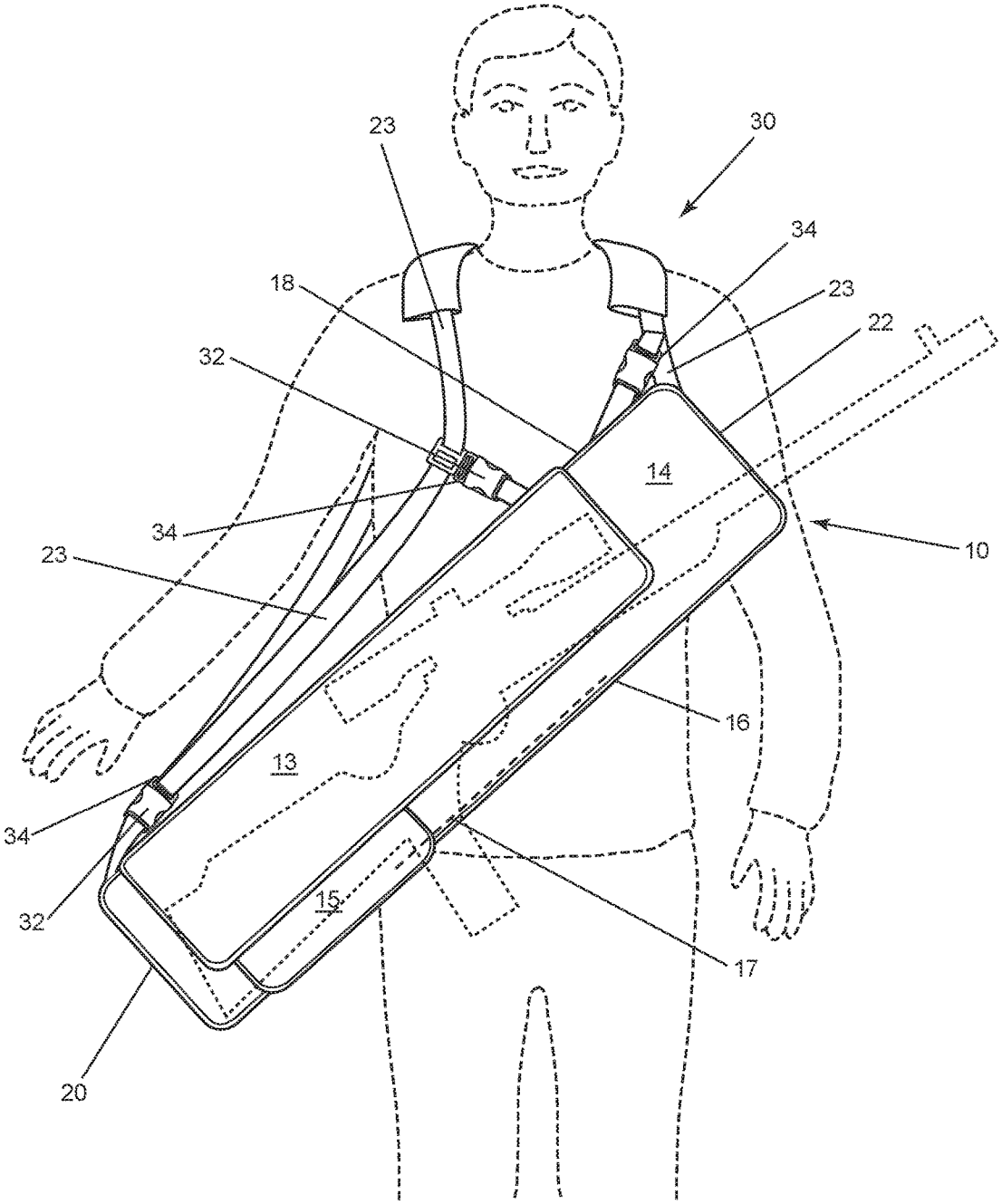
FIG. 1 is a perspective view of an embodiment of the case and harness of the present invention illustrating an attachment of the case to a person using the harness.
Figure 3:
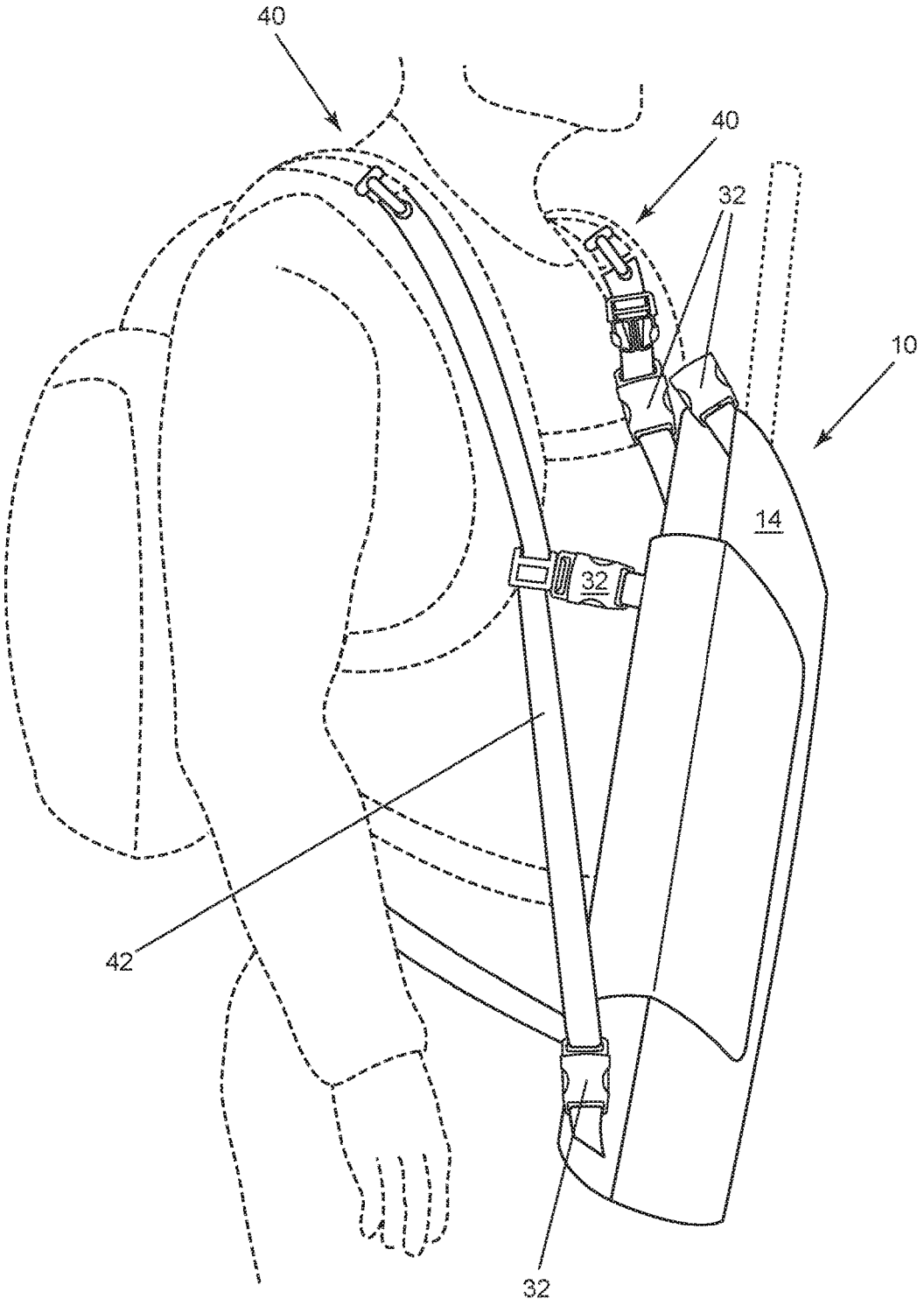
FIG. 3 is a perspective view of an embodiment of the case and retrofit attachments of the present invention illustrating an attachment of the case to the existing backpack of a person.

Referring to the figures, one embodiment of the present invention comprises rifle carrying case 10. Carrying case 10 may be secured to the front of a person by harness 30, one embodiment of which is illustrated in FIG. 1, or it may be secured to the front of a person's backpack by retrofit attachments 40, one embodiment of which is illustrated in FIG. 3. In describing the present invention throughout the specification and claims, note that the phrase "hands free" conveys that hands are not required to support the rifle within case 10 while it is in operation, but does not mean that hands are never required for its use. Also note that the term "about" means within twenty-five percent (25%) of the numerical amount cited.

Case 10 is preferably manufactured out of any material capable of protecting a rifle from the natural elements hunters face in the field, including but not limited to fabric, leather, synthetic materials, cloth, and combinations thereof and the like, and preferably comprises multiple layers of material. For example, case 10 was manufactured of a water resistant, soft, foldable fabric, multiple layers thick with a thin layer of padding between each layer of fabric.

Figure 2:
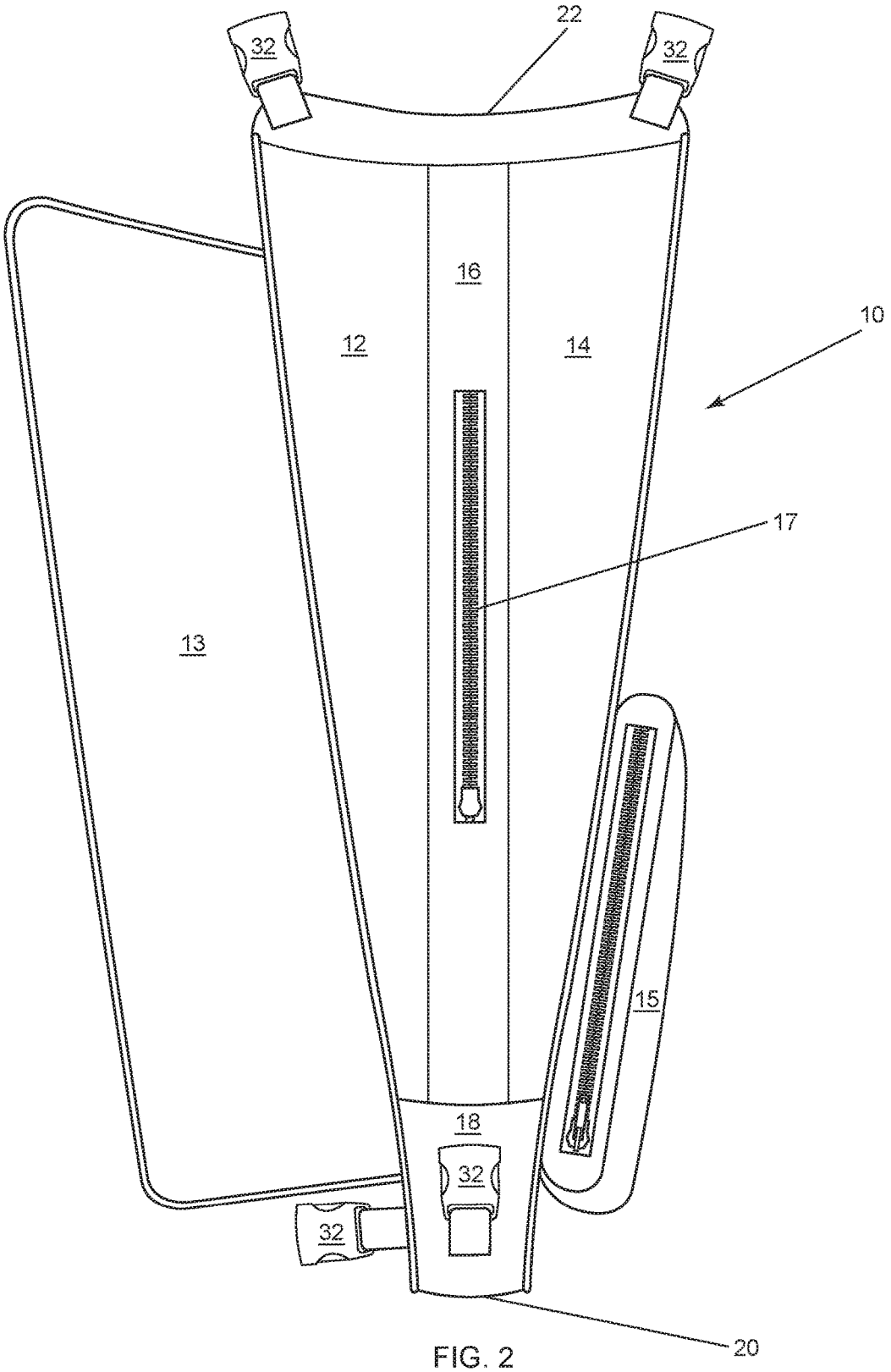
FIG. 2 is a plan view of an embodiment of the case of the present invention as seen from above looking down into the open cradle of the case.

Case 10 is preferably shaped and of any size appropriate to substantially cover and support rifles of varying length, weight, and shape. Referring to FIG. 2, case 10 preferably comprises a back side 12 that is closest or touching the person's body, a front side 14, and a bottom 16 joining sides 12 and 14 to form a cradle to support and substantially surround the rifle. Sides 12 and 14 and bottom 16 need not be separately joined materials, but may be joined by virtue of being one continuous piece of material. Preferably, bottom 16 comprises an aperture 17 to allow any downwardly protruding parts of the rifle like its handle, clip, magazine, or grip, to protrude out of case 10.

Case 10 preferably comprises two opposite ends: butt end 20 and barrel end 22. The butt of the rifle is supported by butt end 20 while the barrel of the rifle protrudes through barrel end 22. Preferably, butt end 20 is sealed in a manner capable of supporting the rifle by the rifle's butt or stock when case 10 is oriented vertically. Butt end 20 is sealed by any means, including but not limited to the sewing of material to sides 12 and 14 and/or bottom 16 or by virtue of being one continuous piece of material with case 10. Barrel end 22 of case 10 comprises an aperture allowing the barrel of the rifle to protrude out of case 10. The rifle is accessed by the person through top 18, which preferably comprises an aperture capable of allowing a rifle to pass up and out of case 10 entirely unobstructed or with only minor maneuvering of the rifle by the person. For example, case 10 was manufactured such that the distance between butt end 20 and barrel end 22 was about two feet and the distance between top 18 and bottom 16 was about eight inches. Bottom 16 was a strip of material about two inches wide that joined the entire length of the bottoms of sides 12 and 14 with butt end 20. The aperture in bottom 16 was about seven inches long, the start of which was located about 6 inches away from butt end 20. The aperture in bottom 16 was sealable by a zipper. The same strip of material that formed bottom 16 formed butt end 20, joining sides 12 and 14 for the entire vertical distance between bottom 16 and top 18, and also joining sides 12 and 14 along about three inches of top 18.

Case 10 preferably comprises attachment mating components 32 for mating with the attachment mating components on harness 30 or on retrofit attachments 40. Attachment mating components 32 may be any attachment device, including but not limited to buckles and fasteners, adequate to support the weight of case 10 containing a rifle, and may be either male or female genders of that attachment device. Preferably, at least two mating components 32 are located on opposite ends of the case, one being near butt end 20 and the other being near barrel end 22. Other attachment mating components may be located anywhere else on case 10 to offer different positions or orientations of securing case 10 to the person. For example, five female snap-fit buckles were located on case 10 at the following places: (1) back side 12 near barrel end 22; (2) front side 14 near barrel end 22; (3) top 18 near butt end 20; (4) back side 12 about six inches away from barrel end 22; and (5) back side 12 about one inch away from butt end 20. This configuration of buckles provided the best support for the rifle, with the least obstruction to access the rifle, while offering the person choices in how to position and orient case 10 in conjunction with harness 30 or retrofit attachments 40.

Case 10 preferably comprises a cover 13 attached to back side 12 one embodiment of which is illustrated in FIGS. 1 and 2. Preferably, cover 13 is of a material capable of protecting the rifle from the natural elements encountered by hunters in the field, including but not limited to water-resistant fabric, and is shaped with dimensions capable of substantially covering the aperture of top 18. For example, cover 13 was manufactured in a rectangular shape with a length of about eighteen inches and a width of about five inches. It was attached along its entire length to back side 12 near top 18. It was made of the same water-resistant fabric as case 10.

Case 10 preferably comprises pockets, one embodiment of which is illustrated in FIGS. 1 and 2 as pocket 15. There may be as many pockets, located on any part of case 10, sealable by any means including but not limited to zippers, Velcro, and netting, and of any dimensions physically capable of attaching to case 10. Preferably, pocket 15 is located on front side 14 to avoid interfering with the person's body, and is located nearer to butt end 20 than barrel end 22 for the best weight distribution. For example, pocket 15 was manufactured in the shape of a rectangular box about six to eight inches long, four to eight inches wide, and one to two inches tall. This size was capable of containing the majority of portable ammunition boxes.

Embodiments of the present invention comprise a harness 30. Referring to FIG. 1, harness 30 preferably comprises two shoulder straps 23 that are joined at back patch 24 on the person's back. Straps 23 may be joined at back patch 24 by any means, including by passing through slits on back patch 24 or by sewing, glue, or by virtue of being part of the same material. Back patch 24 is preferably of a material comfortable for use on a person's back and capable of joining straps 23 while supporting the weight imposed on the straps by case 10 and the rifle, including but not limited to leather, cloth, and synthetic materials. Harness 30 preferably comprises attachment mating components 34 capable of mating with the attachment mating components 32 on case 10, located on straps 23 in such a way that, when mated with attachment mating components 32 on case 10, case 10 is supported on the front of the person hands free while allowing case 10 to be rotated to different positions on the person, including to the person's side. Straps 23 preferably comprise slider buckles located at various positions to allow the person to adjust the length of straps 23 and also the angle or orientation of case 10 relative to a horizontal axis. Straps 23 preferably comprise shoulder pads to prevent chafing of straps 23 on the person's body.

For example, harness 30 was constructed of two straps, one strap for each of the person's shoulders, and both straps were joined at a leather back patch with slits through which each strap passed. The harness had four male snap-fit or side-squeeze attachment buckles, all of which were such that they may be slid along the strap. Two attachment buckles were located on the shoulder strap passing over the person's right shoulder. The first attachment buckle was attached to a slider buckle on the strap such that the attachment buckle projected in a direction perpendicular to the length of the strap. The second attachment buckle was attached to the right strap such that it projected in a direction parallel with the length of the strap. The perpendicular attachment buckle of the right strap was capable of mating with its female component located on back side 12 about six inches away from barrel end 22. The parallel attachment buckle of the right strap was capable of mating with its female component located at top 18 near butt end 20. Other than the slider buckle to which the perpendicular attachment buckle was attached, the right strap had two slider buckles that appeared on the right strap between the parallel attachment buckle and back patch 24, and between the perpendicular attachment buckle and back patch 24. The shoulder strap passing over the person's left shoulder had two attachment buckles, both of which projected in directions parallel with the strap. These two attachment buckles were capable of mating with their female components on case 10 at back side 12 near barrel end 22 and at front side 14 near barrel end 22. Each shoulder strap 22 had a shoulder pad placed on the strap to correspond with the person's shoulders.

Harness 30 preferably comprises a belt strap that allows the person to removably attach back patch 24 to the person's waist belt, thereby preventing slippage of harness 30 in an upward direction on the person's back. Preferably, the belt strap has an attachment buckle or fastener on both ends, one for attaching to back patch 24 and one for attaching to the person's belt. For example, a hook fastener was placed at both ends of a strap about six inches in length, and a slider buckle placed on the length of strap allowed the length to be adjustable. One fastener fastened to a small hole in the bottom of the back patch while the other fastener fastened to a hole on the person's waist belt.

Figure 4:
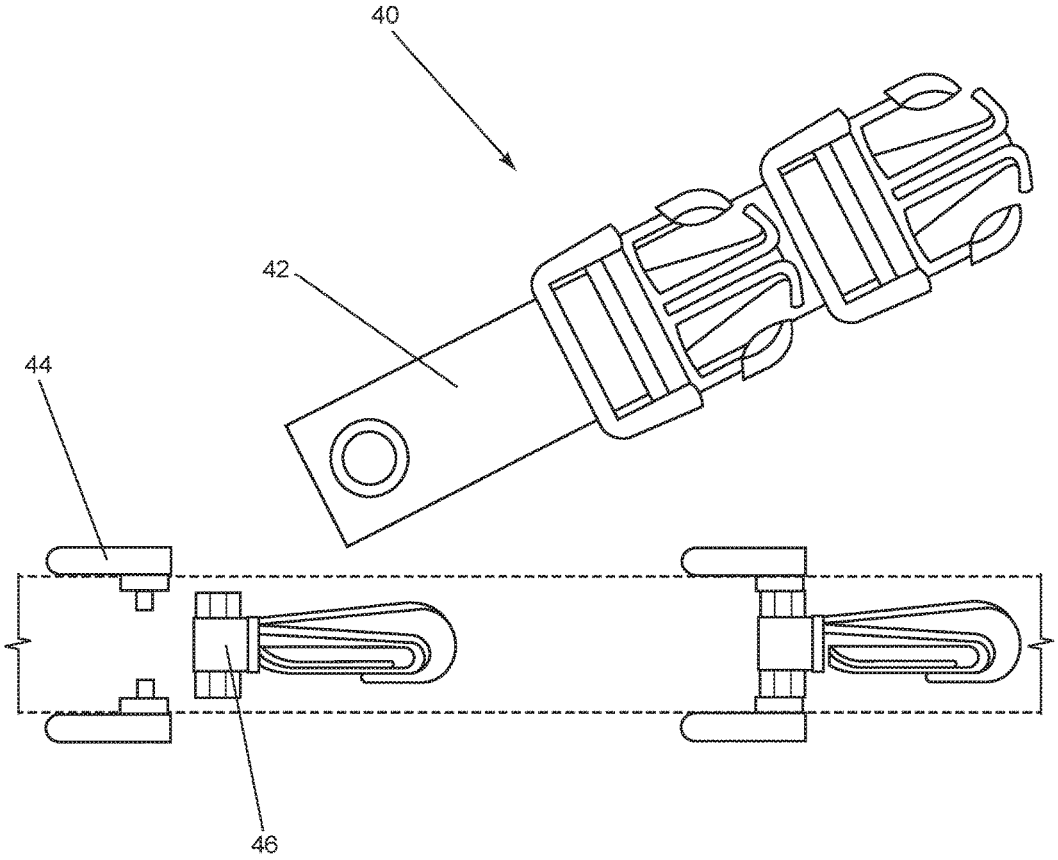
FIG. 4 is an exploded view of an embodiment of the components for attaching the case of the present invention to the strap of an existing backpack.

Many hunters travel with backpacks and would prefer to secure case 10 to the existing straps of the backpack rather than a separate harness. Referring to FIG. 3, embodiments of the present invention comprise retrofit attachments 40, offering a means for removably attaching case 10 to the straps of an existing backpack instead of attaching case 10 to the person by harness 30. Preferably, retrofit attachments 40 comprise a strap 42 that secures case 10 to the front of the person via attachment mating components 32 on case 10. Referring to FIG. 4 illustrating one embodiment of retrofit attachments 40, each retrofit attachment 40 preferably comprises slider buckle 44 capable of attaching to the strap of the existing backpack and movably adjusting its location on the strap. Slider buckle 44 is capable of receiving quick release mechanism 46, which is removably attachable to slider buckle 44 by any means, including but not limited to snap-fit insertions and buckles. Quick release mechanism 46 comprises a means for receiving strap 42, including but not limited to a snap hook. Strap 42 comprises a means for attaching to quick release mechanism 46, including but not limited to a snap hook or a loop hole for receiving a snap hook, and a means for attaching strap 42 to one of the attachment mating components 32 on case 10, including but not limited to snap-fit buckle components of opposite gender as the gender of attachment mating components 32 on case 10.

For example, three retrofit attachments 40 were constructed such that each retrofit attachment had a slider buckle attached to an existing strap of the backpack. Quick release mechanism 46 snapped into the slider buckle as shown in FIG. 4. The first strap had a male snap-fit buckle for mating with the corresponding female component on case 10 at top 18 near butt end 20 and attached to the shoulder strap of the existing backpack on the person's right by a snap hook that received the snap hook of quick release mechanism 46. A second and third strap were constructed identical to each other, were smaller in length than the first strap, and each had two male snap-fit buckles for mating with corresponding female components on case 10 and a loop hole for receiving the snap hook of quick release mechanism 46. In order to provide the maximum number of options for positioning and orienting case 10 on the person, the second strap was attached to the shoulder strap of the existing backpack on the person's right at a location on the backpack strap above where the first strap was attached, and the third strap was attached to the shoulder strap of the existing backpack on the person's left. This position of the second strap allows the person to orient the case such that the barrel end of the rife is vertically oriented on the person's right side.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all patents, references, and publications cited above are hereby incorporated by reference.

What is claimed is:

1. A rifle carrier apparatus comprising:

a flexible case having a back side, a front side, a bottom joining said back side and said front side to form a cradle to support a rifle, a top above said bottom having an aperture to allow a person access to the rifle in said case, a butt end capable of supporting the rifle within said case by the butt of the rifle when said case is oriented vertically, a barrel end opposite said butt end having an aperture to allow the barrel of the rifle to protrude from said case, and at least two attachment mating components; and a harness capable of supporting said case on the front of the person, said harness having at least two shoulder straps, a back patch joining said at least two shoulder straps on the back of the person, and at least two attachment mating components capable of removably mating with said at least two attachment mating components on said case;

wherein one of said at least two attachment mating components on said case is located on said back side of said case near said barrel end of said case, a second of said at least two attachment mating components on said case is located on said front side of said case near said barrel end of said case, and a third of said at least two attachment mating components on said case is located on said top of said case near said butt end of said case.

2. The rifle carrier apparatus of claim 1 wherein said case comprises a cover flap attached to said back side of said case, said cover flap shaped and sized to cover most of said top of said case.

3. The rifle carrier apparatus of claim 1 wherein said bottom of said case comprises a sealable aperture running along a length of said bottom to allow the rifle clip or rifle handle to protrude from said case through said aperture.

4. The rifle carrier apparatus of claim 1 wherein at least one pocket capable of containing objects is attached to said front side of said case.

5. The rifle carrier apparatus of claim 1 wherein said harness comprises a strap attachable to the person's belt.

6. The rifle carrier apparatus of claim 1 wherein said harness comprises shoulder pads removably attachable to each of said at least two shoulder straps.

7. The rifle carrier apparatus of claim 1 wherein said harness comprises slider buckles capable of adjusting the length of said at least two shoulder straps.

8. A rifle carrier apparatus comprising:

a flexible case having a back side, a front side, a bottom joining said back side and said front side to form a cradle to support a rifle, a top above said bottom having an aperture to allow the person access to the rifle in said case, a butt end capable of supporting the rifle within said case by the butt of the rifle when said case is oriented vertically, a barrel end opposite said butt end having an aperture to allow the barrel of the rifle to protrude from said case, at least two attachment mating components; and attachment components to attach said case to the straps of a backpack; wherein one of said at least two attachment mating components on said case is located on said back side of said case near said barrel end of said case, a second of said at least two attachment mating components on said case is located on said front side of said case near said barrel end of said case, and a third of said at least two attachment mating components on said case is located on said top of said case near said butt end of said case.

9. The rifle carrier apparatus of claim 8 wherein said case comprises a cover flap attached to said back side of said case, said cover flap shaped and sized to cover most of said top of said case.

10. The rifle carrier apparatus of claim 8 wherein said bottom of said case comprises a sealable aperture running along a length of said bottom to allow the rifle clip or rifle handle to protrude from said case through said aperture.

11. The rifle carrier apparatus of claim 8 wherein at least one pocket capable of containing objects is attached to said front side of said case.

* * * * *